US006826808B2

(12) United States Patent
Kutschka

(10) Patent No.: US 6,826,808 B2
(45) Date of Patent: Dec. 7, 2004

(54) ZIPLOCK FOR POUCHES AND BAGS

(75) Inventor: Martin Kutschka, Graz (AT)

(73) Assignee: Zip Pack IP AG, Goldach (CH)

( * ) Notice: Subject to any disclaimer, the term of this patent is extended or adjusted under 35 U.S.C. 154(b) by 0 days.

(21) Appl. No.: 10/363,770

(22) PCT Filed: Sep. 6, 2001

(86) PCT No.: PCT/IB01/01873

§ 371 (c)(1),
(2), (4) Date: Mar. 6, 2003

(87) PCT Pub. No.: WO02/21959

PCT Pub. Date: Mar. 21, 2002

(65) Prior Publication Data

US 2003/0172501 A1 Sep. 18, 2003

(30) Foreign Application Priority Data

Sep. 8, 2000 (CH) ..... 1758/00
Jun. 8, 2001 (CH) ..... 1043/01

(51) Int. Cl.[7] ..... A44B 19/26

(52) U.S. Cl. ..... 24/427; 24/399; 24/585.12; 24/585.1; 24/DIG. 39; 383/64

(58) Field of Search ..... 24/427, 397, 585.1, 24/585.12, DIG. 39, DIG. 38; 383/64, 66

(56) References Cited

U.S. PATENT DOCUMENTS

| | | | | | |
|---|---|---|---|---|---|
| 1,959,319 | A | * | 5/1934 | Sipe | 24/400 |
| 2,581,604 | A | | 8/1952 | Roehrl | |
| 3,259,951 | A | * | 7/1966 | Zimmerman | 24/399 |
| 3,579,747 | A | * | 5/1971 | Hawley | 24/400 |
| 3,627,600 | A | * | 12/1971 | Reiter | 156/66 |
| 5,020,194 | A | * | 6/1991 | Herrington et al. | 24/400 |
| 5,638,586 | A | * | 6/1997 | Malin et al. | 24/585.12 |
| 5,809,621 | A | | 9/1998 | McCree et al. | |
| 2002/0154835 | A1 | * | 10/2002 | Galomb | 383/64 |

FOREIGN PATENT DOCUMENTS

| | | |
|---|---|---|
| FR | 1168794 | 12/1958 |
| FR | 2773679 | 7/1999 |
| FR | 2784873 | 4/2000 |

* cited by examiner

*Primary Examiner*—Robert J. Sandy
(74) *Attorney, Agent, or Firm*—Frost Brown Todd LLC

(57) ABSTRACT

The invention relates to a closure (3) that comprises two interacting pairs of locking ribs (23, 33) that function in pairs. Said locking ribs (23, 33) are formed integrally with connecting strips (17, 21) in which guide ribs (27, 37) are configured which engage in a common glider (31). The closure (3) is opened by conical grooves (29, 39) inside the glider (31) which modify the distance between the two guide ribs (27, 37) by pushing apart and separating or reuniting and joining them.

16 Claims, 5 Drawing Sheets

ZIPLOCK FOR POUCHES AND BAGS

The invention pertains to a closure for pouches and bags according to the preamble of Claim 1.

Pouches and bags that need to be reclosed after they were initially opened frequently comprise ziplock closures or profiled closures with two cooperating profile strips. Such profiled closures can be connected to one another by pressing together the strips. Alternatively, a slider is attached onto the closure and encompasses the profile strips. The profile strips can be pulled apart or pushed together, i.e., opened or closed, by displacing the slider along the strips. Since the slider encompasses the two profile strips in order to press together or pull apart the strips, it is not possible to arrange carrying straps above the closure on pouches and bags of this type. If carrying straps are side-connected to the pouch or bag walls, the costs are increased to a degree that is unjustifiable for disposable articles of this type. In addition, the carrying straps interfere with emptying the pouch or bag.

The invention is based on the objective of developing a closure with interlocking profile strips and with a slider for opening and for closing the profile strips, wherein said closure can be arranged on pouches and bags that can be provided with a carrying handle above the closure.

This objective is attained with a closure with the characteristics of Claim 1. Other advantageous configurations of the closure are defined in the dependent claims.

According to the invention, the closure comprises a slider that is arranged to the side of the profile strips in the plane of the bag wall. Consequently, it is possible to attach at least one handle on one of the two profile strips that can optimally absorb the load of the bag contents. According to the invention, the bag walls are coupled or connected to the profile strips in such a way that the internal pressure of the bag contents cannot separate the interlocked profile strips. This is achieved due to the fact that the load of the bag contents do not subject the closure to any shearing forces, but only tensile forces. The load is also uniformly distributed over both profile strips when carrying the bag or pouch. This prevents the bag from being opened unintentionally.

Figure 1:
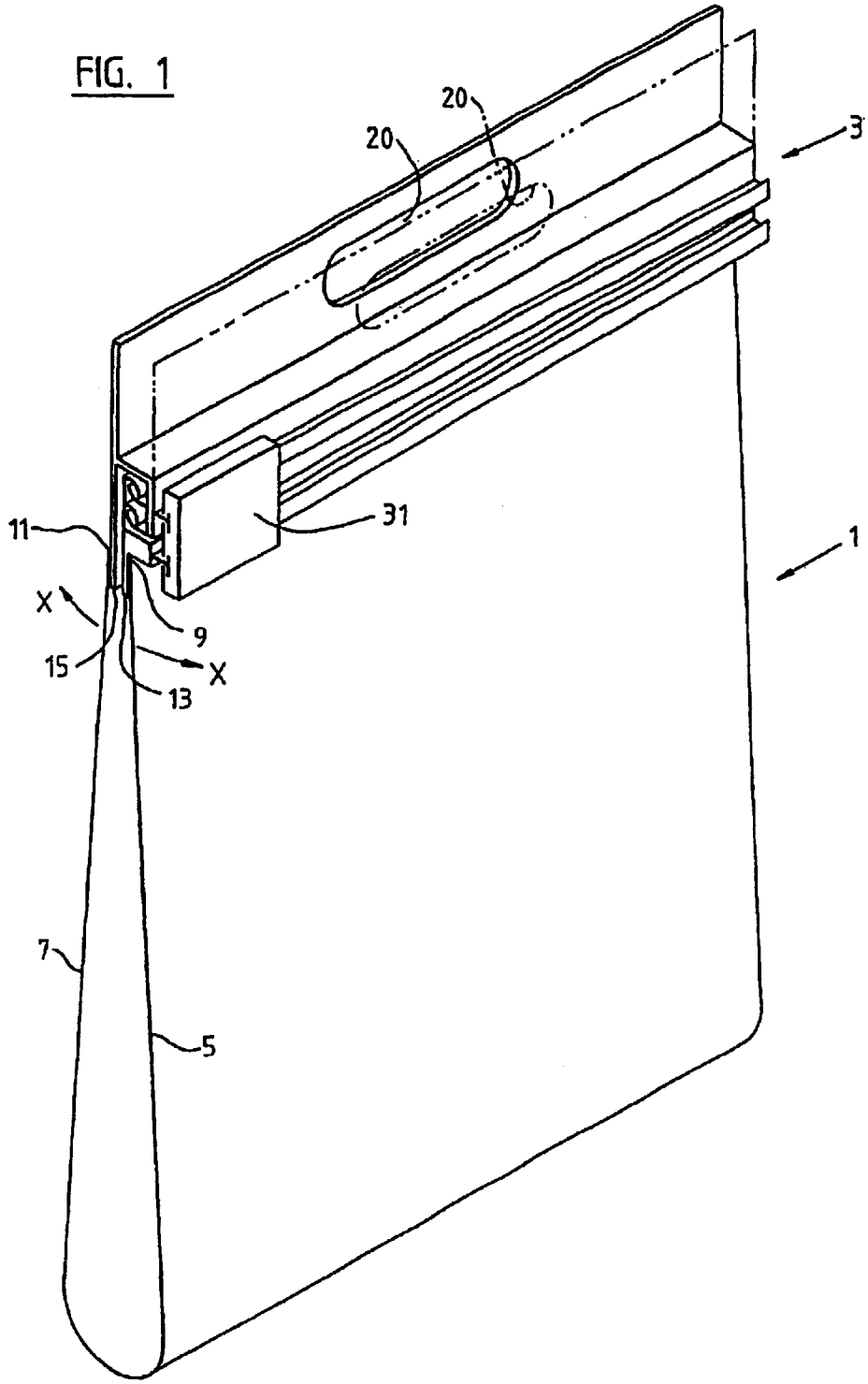
Figure 2:
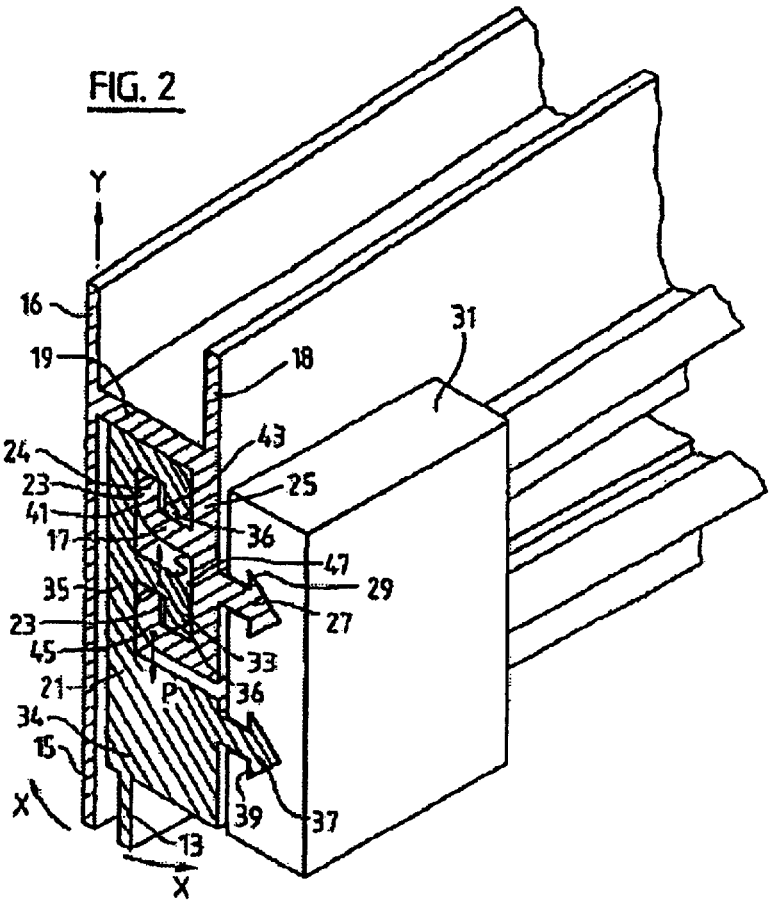
Figure 3:
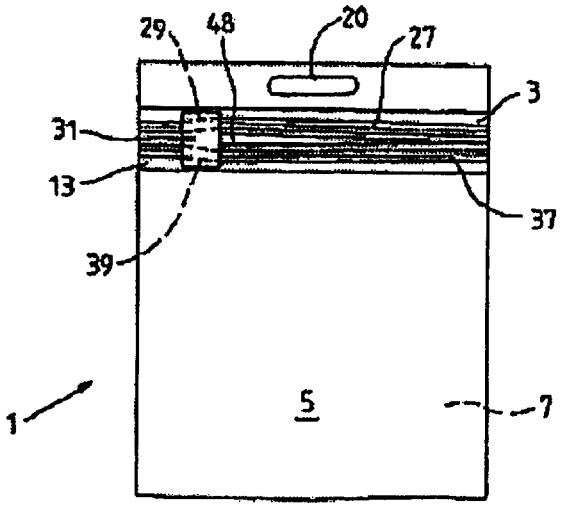
Figure 4:
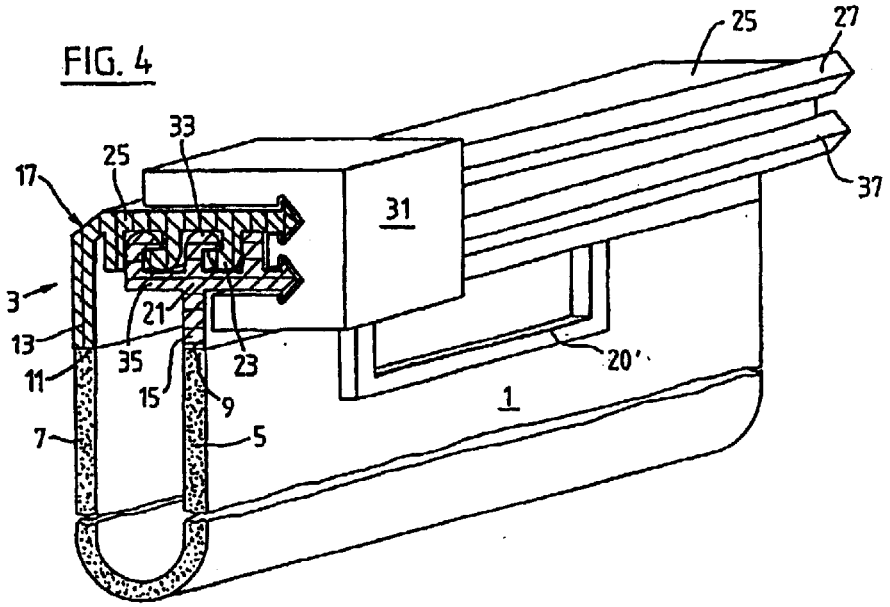
Figure 5:
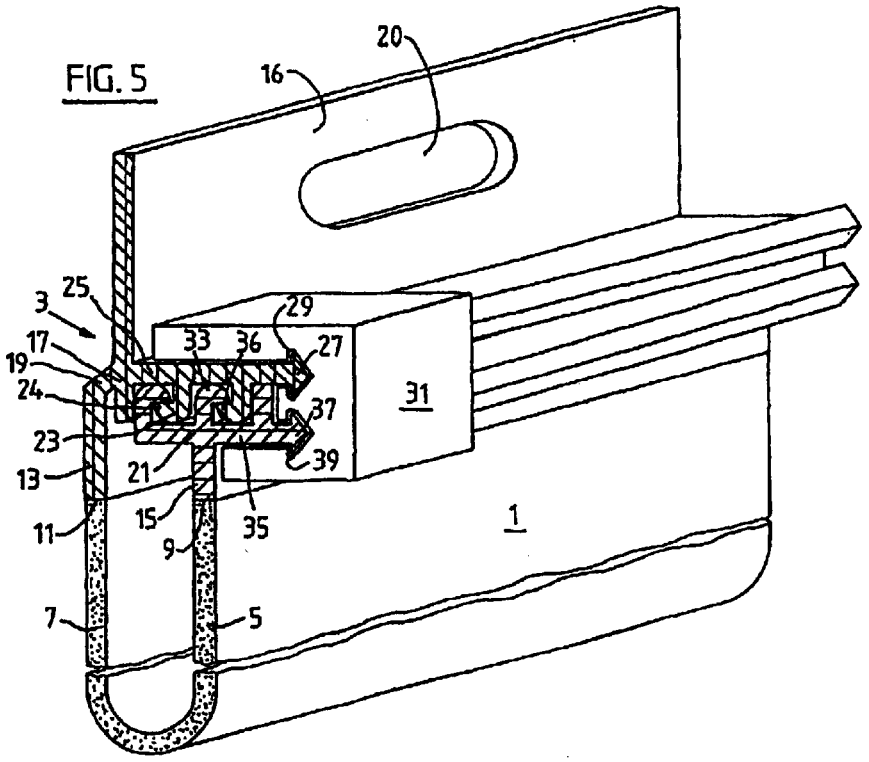
Figure 6:
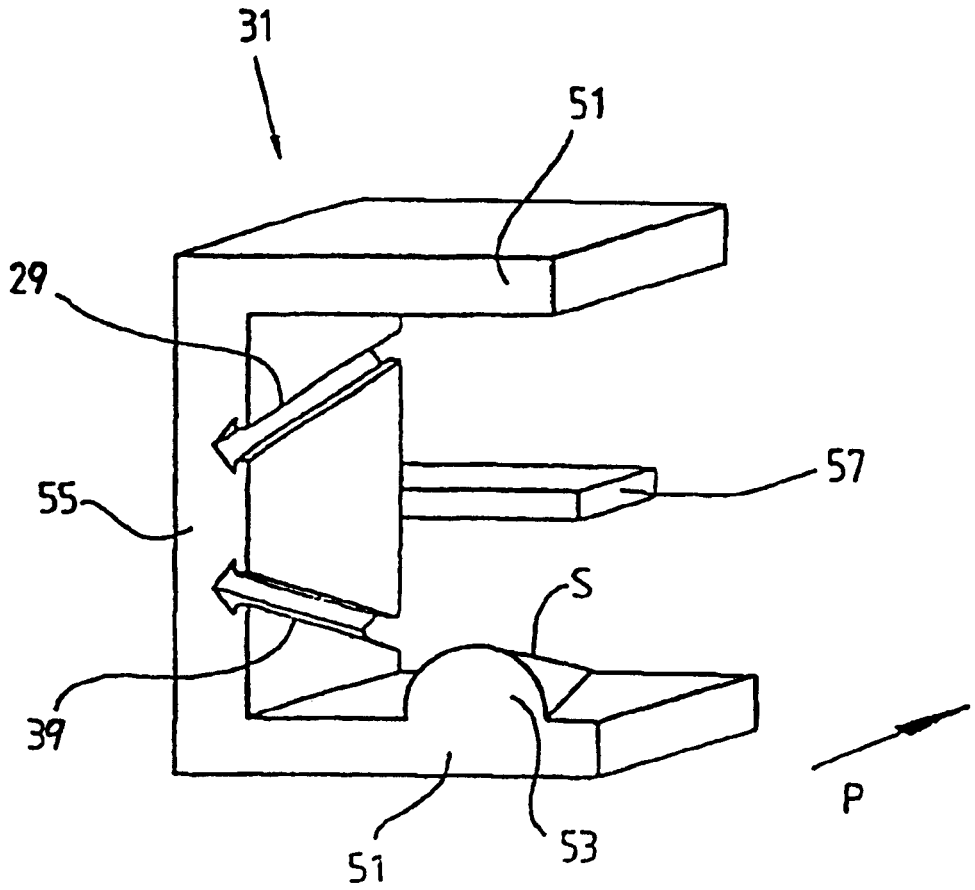
Figure 7:
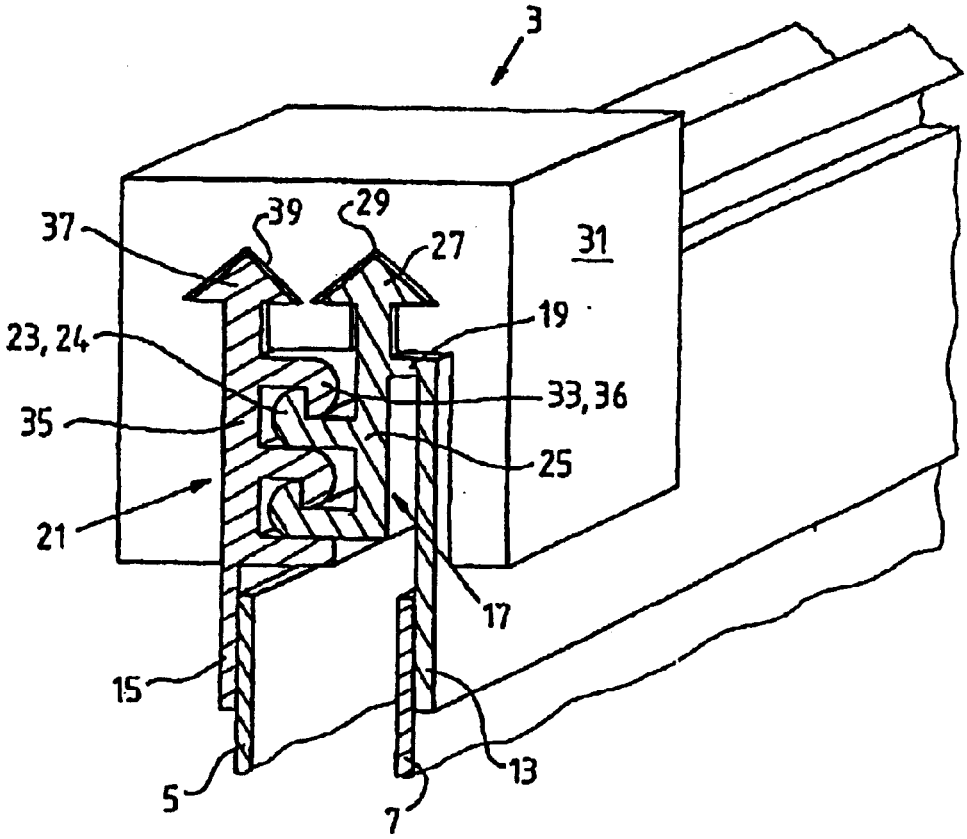

The invention is described in greater detail below with reference to two embodiments that are illustrated in the figures. The figures show:

FIG. 1, a side view of a pouch or bag with attached closure and slider;

FIG. 2, an enlarged cross section through the closure;

FIG. 3, a view of a partially opened pouch;

FIG. 4, a side view of a pouch or bag with another configuration of the closure;

FIG. 5, a pouch or bag with the closure according to FIG. 4 and with a handle opening;

FIG. 6, a perspective representation of another configuration of the slider with a closing aid and an opening aid, and FIG. 7, an enlarged cross section through another configuration of the closure.

FIG. 1 shows schematically a pouch or bag 1 with a closure 3 attached to it. The size relations between the bag 1 and the closure 3 are not illustrated true-to-scale; the closure 3 is shown much larger than is actually the case. The bag 1 comprises two side walls 5 and 7, the free upper edges 9 and 11 of which are connected along the opening with connecting strips 13, 15 of the closure 3. The connection between the bag 1 and the closure 3 can be produced by gluing and sewing, gluing, sealing, welding and/or sewing. The connecting strips 13, 15 of the closure 3 can be attached to the outside or the inside of the bag side walls 5, 7.

A first embodiment of the closure 3 is described in greater detail below with reference to the enlarged representation according to FIG. 2. The connecting strip 15 on the first profile strip 17 is connected by a web 19 to two locking ribs 23 of hook-shaped cross section that engage with the second profile strip 21. The locking ribs 23 form pad of the base limb 25 of the first profile strip 17. As shown in FIG. 2, each locking rib 23 comprises a hook 24 and a flange. The hooks 24 on the locking ribs 23 are directed upward. An undercut guide rib 27 is arranged on the rear side of the base limb 25, i.e., opposite the ribs 23. This guide rib 27 extends parallel to the locking ribs 23. The guide rib 27 lies in a groove 29 in a slider 31, wherein the geometry of the groove corresponds to that of the guide rib 27. A carrying strip 16 that is provided with a handle opening 20 can be integrally formed onto the web 19 in an extension of the connecting strip 15.

The second profile strip 21 also comprises two locking ribs 33, the hooks 36 of which are directed downward and engage behind the locking ribs 23 of the first profile strip 17 from the top. The locking ribs 33 are also arranged on a base limb 35, on the bottom of which the connecting strip 13 is arranged. As is also the case with the first profile strip 17, a guide rib 37 is provided on the base limb 35. In FIG. 2, this guide rib is situated below the guide rib 27 on the first profile strip 17, and extends parallel to it. It also lies within a second guide groove 39 in the slider 31. The two guide ribs 27 and 37 can be arranged directly beneath one another as shown in FIG. 2; however, they can also be horizontally offset if the lower section 34 of the base limb 35 has a shorter horizontal dimension than that shown in FIG. 2.

FIG. 2 also shows that the first profile strip 17 completely encompasses the second profile strip 21 at least in the upper section. In other words, the second profile strip 21 lies with its two locking ribs 33 within the first profile strip 17.

The locking ribs 23 of the first profile strip 17 and the locking ribs 33 of the second profile strip 21 respectively extend parallel to one another in pairs, and are respectively spaced apart from one another by the same distance.

By contrast, the two grooves 29 and 39 in the slider 31 run at an acute angle to one another, wherein the distance between the two grooves 29 and 39 on the end, i.e., the front end in FIG. 2, corresponds to the distance shown between the two guide ribs 27 and 37. The distance between the two grooves 29 and 39 is greater on the opposite side of the slider 31. Because of this, the locking ribs 23 and 33 that are interconnected at the front of the slider in FIG. 2 are pulled apart or disengaged behind the slider 31 so that the interior of the pouch or bag 1 becomes accessible.

This means that the two profile strips 17, 21 are pulled apart and mutually disengaged by increasing the distance between the two guide rib pairs 27 and 37. This increase in distance simultaneously pivots the claw-shaped locking ribs 23 and 33 in the direction of the arrows P and S. Due to the spreading of the interconnected pairs of ribs 23, 33, the two contact surfaces 41 and 43 on the locking ribs 23 and 33 that were initially flat alongside one another move apart and are mutually disengaged. Before they slide apart, the two contact surfaces 41 and 43 assume an inclined position that promotes their sliding apart and prevents damage to the locking ribs 23 and 33 during this process. The sliding apart of the contact surfaces is additionally simplified by the cylindrical peripheral surfaces 45 and 47 of the locking ribs 23 and 33. At the same time, the cylindrical design of the surfaces 45, 47 promotes interlocking of the two profile strips 17 and 21 when they are united to close off the bag opening. By contrast to the elastic locking ribs 23 and 33, the guide ribs 27 and 37 that engage into the slider 31 are made rigid at least to the degree that they cannot be disengaged from the grooves 29 and 39 in the slider 31 under a load. This means that a very rigid connection is produced between the two profile strips 17 and 21 and the slider 31, and that an elastic connection is produced between the two profile strips 17 and 21.

However, the elastic connection between the two profile strips 17 and 21 can be disengaged only if they are correspondingly spread apart by the slider 31. The connection cannot be disengaged by the pressure of the contents of the pouch or bag 1 because the interlocking connection between the locking ribs 23 and 33 is additionally reinforced if the connecting strips 13, 15 are spread apart in the direction of the two arrows X. This also occurs when the pouch or bag 1 is lifted by the carrying strip 16 because this causes a force to be exerted in the direction of the arrow Y. If an additional carrying strip 18 is arranged on the first profile strip 17 in an extension of the base limb 25 and provided with a handle opening 20, the interlocking connection between the two locking rib pairs 23 and 33 is also additionally reinforced.

FIG. 3 shows the pouch 1 in the partially opened state. The slider 31 is displaced approximately to its left end position and has pulled apart the guide ribs 27, 37 by means of the acutely angled grooves 29 and 39 such that an opening 48 is formed. The opening 48 can be reclosed by displacing the slider 31 toward the right. This displacement toward the right reunites the two guide ribs 27 and 37 such that the locking ribs 23 and 33 are interlocked.

In another configuration of the invention (FIGS. 4/5), the closure 3 is turned by 90° and the two base limbs 25, 35 extend horizontally, i.e., perpendicular to the bag side walls 5, 7. The hooks and the locking ribs are realized and function in the same fashion as those described above with reference to FIGS. 1-3. The guide ribs 27, 37 in this case also lie in a plane that extends parallel to the bag side wall 5, wherein the guide ribs are also guided in identically designed guide grooves 29, 39 in the slider 31. The handle opening 20 in the carrying strip 16 is realized analogously to the first embodiment. The carrying strip 16 is also connected to the connecting strip 15 and the profile strip 17 (FIG. 5) in essentially the same plane. As an alternative to the handle opening 20 used in FIGS. 1-3 and 5, a handle bow 20' can be sewn and/or welded to the profile strip 17 or the bag. The closure 3 shown in FIGS. 4 and 5 is opened by displacing the slider 31. By contrast to the first embodiment, the locking rib pairs 23, 33 are successively spread apart by the slider 31 and mutually disengaged.

In the embodiment according to FIG. 6, the slider 31 has a u-shaped cross section. The two limbs 51 are integrally formed onto the base 55 of the slider 31, with the two converging guide grooves 29, 39 being recessed into the base 55 between the two limbs. A conically extending rib 53 is formed on one of the two limbs 51. This rib can have the shape of a cone section. The upper apex S of the rib 51 extends essentially parallel to the adjacent guide groove 39. A spreading or separating finger 57 is arranged on the end face of the base 55 such that it extends parallel to the two limbs 51.

The conical rib 51 presses the two locking rib pairs 23, 33 together when uniting the two closure halves (profile strips 17 and 21) by displacing the slider 31 in the direction of the arrow P; the spreading finger 57 presses the locking rib pairs apart when the slider 31 is displaced in the opposite direction.

In the configuration of the invention according to FIG. 7, the slider 31 is turned by 90° relative to the side walls 5, 7. The guide grooves 29, 39 now lie above the locking rib pairs 23, 33 rather than beside them. Consequently, the two guide ribs 27, 37 are also situated at the upper end and form the upper edge of the closed pouch 1. The function of this closure is identical to that of the other embodiments.

What is claimed is:

1. A closure for pouches and bags, comprising two profile strips that can be interconnected and a slider that is engaged with the two profile strips and serves to unite and separate the two profile strips, wherein:

the first profile strip comprises a first base limb, onto which two locking ribs are integrally formed, each locking rib comprising a hook and a flange connecting the hook to the base limb, the hooks being directed from their respective flange in the same direction, and a first connecting strip for connecting the first profile strip to one wall of the pouch or bag is integrally formed onto the base limb;

the second profile strip comprises a second base limb onto which two locking ribs with hooks and the second connecting strip are integrally formed, the hooks being directed in the opposite direction as the hooks on the first profile strip; and an undercut guide rib is respectively provided on the first and on the second profile strips, wherein both guide ribs engage in correspondingly shaped guide grooves in the slider.

2. The closure of claim 1, wherein the first profile strip surrounds or encompasses the two locking ribs of the second profile strip.

3. The closure of claim 1, wherein the locking ribs on the first profile strip have upwardly directed hooks and the locking ribs on the second profile strip have downwardly directed hooks.

4. The closure of claim 1, wherein the hooks of the locking ribs of the first and second profile strips are aligned.

5. The closure of claim 1, wherein the hooks of the locking ribs of the first and second profile strips tightly contact one another in the interconnected state.

6. The closure of claim 1, wherein the slider has a front end and a rear end, and the distance between the grooves provided in the slider for the guide ribs increases from a first end face on the front end toward a second end face on the rear end.

7. The closure of claim 1, further comprising a carrying strip with a handle opening integrally formed onto the first profile strip.

8. The closure of claim 1, further comprising a handle bow integrally formed onto the first profile strip.

9. The closure of claim 1, wherein when connected to a bag having side walls, the two base limbs of the profile strips are parallel to the bag side walls.

10. The closure of claim 1, wherein the slider has an essentially u-shaped cross section with two limbs, the slider further comprising a conically extending rib integrally formed onto one of the two limbs wherein the apex line of the conical rib essentially extends parallel to the adjacent guide groove.

11. The closure of claim 10, wherein the slider rib is in the form of a cone section.

12. The closure of claim 10, further comprising a spreading finger integrally formed onto the base of the slider, wherein said spreading finger extends parallel to the limbs and lies between the latter.

13. A closure for couches and baas comprising two profile strips that can be interconnected and a slider that is engaged with the two profile strips and serves to unite and separate the two profile strips, wherein:

the first profile strip comprises a first base limb, onto which two locking ribs with hooks are integrally formed, and a first connecting strip for connecting the first profile strip to one wall of the pouch or baa is integrally formed onto the base limb;

the second profile strip comprises a second base limb onto which two locking ribs with hooks and the second connecting strip are integrally formed; and an undercut guide rib is respectively provided on the first and on the second profile strips, wherein both guide ribs engage in correspondingly shaped guide grooves in the slider;

wherein the first profile strip surrounds or encompasses the two locking ribs of the second profile strip.

14. The closure of claim 13, wherein the slider has an essentially u-shaped cross section with two limbs, the slider further comprising a conically extending rib integrally formed onto one of the two limbs wherein the apex line of the conical rib essentially extends parallel to the adjacent guide groove.

15. The closure of claim 14, wherein the rib is in the form of a cone section.

16. The closure of claim 15, further comprising a spreading finger integrally formed onto the base of the slider, wherein said spreading finger extends parallel to the limbs and lies between the latter.

* * * * *

UNITED STATES PATENT AND TRADEMARK OFFICE

CERTIFICATE OF CORRECTION

PATENT NO. : 6,826,808 B2
DATED : December 7, 2004
INVENTOR(S) : Kutschka

It is certified that error appears in the above-identified patent and that said Letters Patent is hereby corrected as shown below:

Column 4,
Line 64, should read -- A closure for pouches and bags comprising two profile --.

Column 5,
Line 4, should read -- first profile strip to one wall of the pouch or bag is --.

Signed and Sealed this

Nineteenth Day of April, 2005

JON W. DUDAS
*Director of the United States Patent and Trademark Office*